United States Patent [19]

Kauss

[11] Patent Number: 5,040,367

[45] Date of Patent: Aug. 20, 1991

[54] BLOCKING VALVE CONTROL SYSTEM FOR LIFT DRIVEN BY VARIABLE DISPLACEMENT PUMP

[75] Inventor: Wolfgang Kauss, Lohr/Wombach, Fed. Rep. of Germany

[73] Assignee: Mannesmann Rexroth GmbH, Lohr/Main, Fed. Rep. of Germany

[21] Appl. No.: 502,988

[22] Filed: Apr. 2, 1990

[30] Foreign Application Priority Data

Apr. 5, 1989 [DE] Fed. Rep. of Germany ..... 3911022

[51] Int. Cl.[5] ..... F15B 11/08

[52] U.S. Cl. ..... 60/452; 91/445; 91/447; 91/461

[58] Field of Search ..... 60/445, 452; 91/445, 91/446, 447, 461

[56] References Cited

U.S. PATENT DOCUMENTS 4,542,678 9/1985 Kochendorfer et al. ..... 91/445 X 4,667,570 5/1987 Jensen et al. ..... 91/446 X 4,960,035 10/1990 Kauss ..... 91/447 X

*Primary Examiner*—Edward K. Look

*Assistant Examiner*—George Kapsalas

*Attorney, Agent, or Firm*—Burns, Doane, Swecker & Mathis

[57] ABSTRACT

A hydraulic lift is raised by hydraulic fluid which passes through a servo valve and is lowered when the servo valve exhausts the hydraulic lift to a reservoir. The hydraulic fluid travels to and from the lift through a service line in which a blocking valve is disposed. A control unit opens the blocking valve against a spring bias in response to the application of a control pressure to a control element disposed on one side of the control unit. The control pressure is supplied via a control line which also actuates the servo valve. A branch control line branches from the control line and applies pressure to another control element which acts counter to the first-mentioned control element. The branch control line includes tow throttles between which a discharge line is connected and communicates with the reservoir.

4 Claims, 1 Drawing Sheet

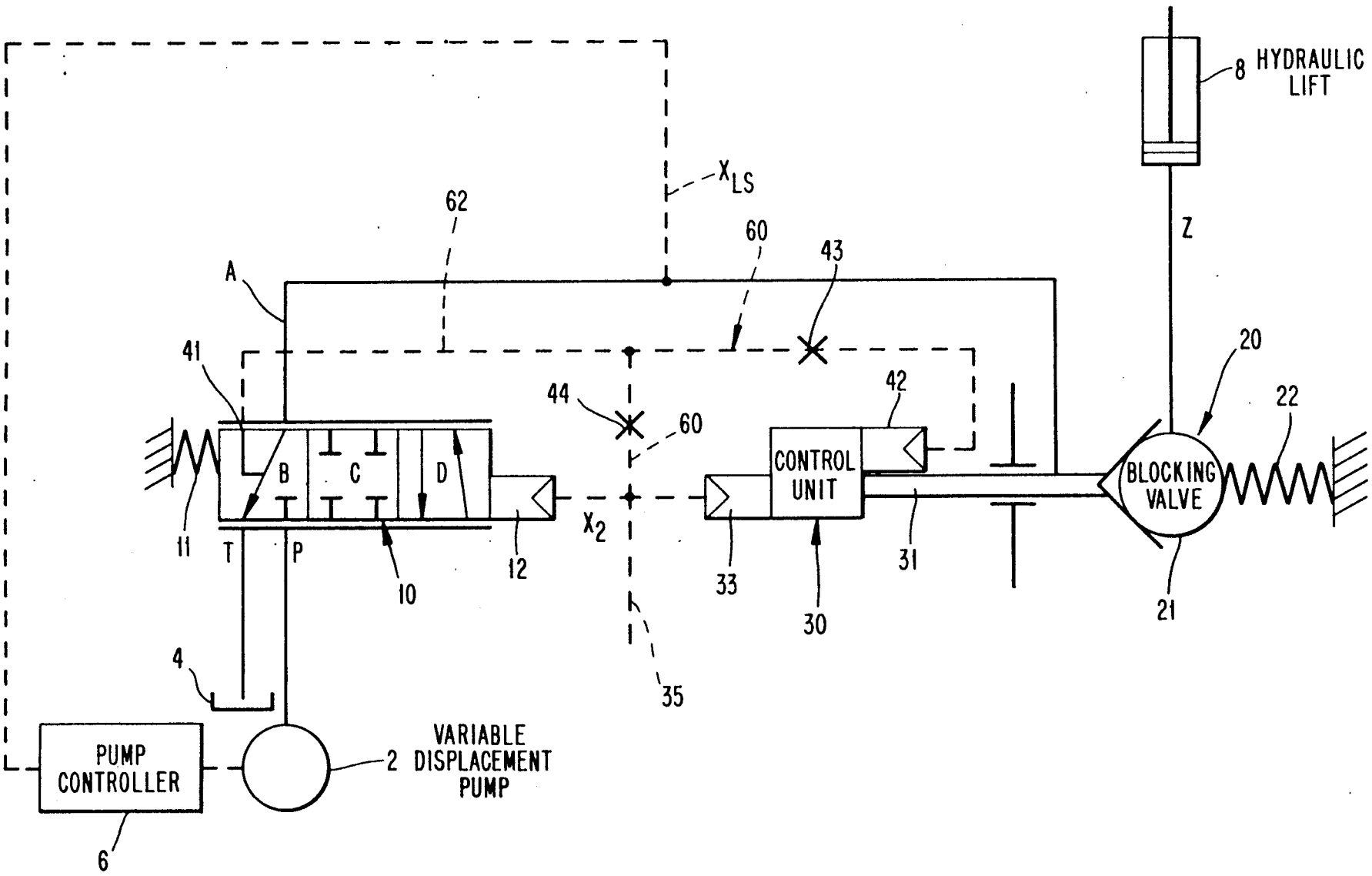
HYDRAULIC LIFT
8
Z
20
22
BLOCKING VALVE
21
42
31
CONTROL UNIT
30
33
43
60
$X_{LS}$
60
35
44
$X_2$
12
62
D
C
B
10
P
T
A
41
11
4
VARIABLE DISPLACEMENT PUMP
2
PUMP CONTROLLER
6

BLOCKING VALVE CONTROL SYSTEM FOR LIFT DRIVEN BY VARIABLE DISPLACEMENT PUMP

RELATED INVENTIONS

The invention disclosed herein is related to inventions disclosed in commonly assigned U.S. Pat. Nos. 4,967,554 and 4,960,035, both filed Sept. 22, 1988, as well as Ser. No. 502,995 filed concurrently herewith (corresponding to German Application No. P 3910895.3 filed Apr. 4, 1989). The disclosures of those applications are incorporated herein by reference.

BACKGROUND OF THE INVENTION

The invention refers to a control system for a hydraulic power lift driven by a variable displacement pump.

There is already known a control system for a hydraulic power lift driven by a variable displacement pump which has a blocking valve that can be opened at least for lowering of the power lift. A load-indicating line controls the load pressure from the pump. A control device switches the one-way valve open and closed and regulates the volumetric flow from a pump line into a load line leading to the power lift (or from the power lift into a tank line leading to a reservoir).

In such control system, a servo valve is provided which: (i) actuates a blocking valve or blocking element using one guiding edge, (ii) actuates a hydraulic component that switches the variable displacement pump (which feeds a hydraulic system) into different operational modes using another guiding edge, (iii) regulates a pump feed flow between a pump line and a service line that leads to the power lift and in which the blocking element rests using another guiding edge with a variable opening surface, and (iv) regulates a reservoir flow between the service line and a tank line using yet another guiding edge with a variable opening surface.

This conventional control system was necessary for a hydraulic system fed by a fixed-displacement pump since in the neutral of the servo valve in such hydraulic systems the fixed-displacement pump had to be switched off and the blocking element rendered closed to avoid high power losses. This control system is also used for hydraulic systems that are driven by variable displacement pumps to reduce power losses.

For the switching and volumetric flow regulating functions of the servo valve, considerable disadvantages result from the obligatory linkage of switching functions and volumetric flow regulating functions insofar as the dynamics and the precision of the control system are limited. This results in a reduced response behavior quality of the control system since when the service line leading to the consuming device or to the power lift is connected, only a gradual pressure build-up in the service line can take place.

To resolve the task of developing the control system in such a way that with simple construction and economical fabrication the response behavior of the power lift is improved, a control system was proposed in the afore-mentioned U.S. Pat. No. 4,960,035. That control system is for a hydraulic lift driven by a variable displacement pump. The system comprises a blocking valve which may be opened to permit a flow of hydraulic fluid to and from the lift. An actuator unit is provided for opening and closing the blocking valve. A servo valve is provided for regulating the volumetric flow to and from the hydraulic lift. The servo valve has three valve positions such that in an initial position, a service line leading to the hydraulic lift is connected to a reservoir. A middle position of the servo valve constitutes a blocking position. The next position of the servo valve connects the service line to the pump. A load sensing or registration line senses fluid pressure coming from the servo valve in order to control the displacement of the pump. The blocking valve and servo valve are controlled by control pressure from a common control line.

The use of the variable displacement pump in conjunction with such a control device allows the switching functions of the control system to be separated from the volumetric flow regulating function. The control system therefore enables different operational demands required of the power lift to be dealt with greater versatility. If precision and reaction speed are required, the variable displacement pump is operated in a load-sensing mode and the blocking element remains open. In operational phases with lesser supply demands, e.g., for driving a vehicle equipped with a hydraulic power lift and under load, the variable displacement pump can be switched in the standby mode by connecting the load-indicating line to a reservoir. By doing so, the blocking valve is automatically closed and the load is thereby secured. As the variable displacement pump is always switched to load pressure before the blocking valve opens, a pre-control of the blocking element can be dispensed with even in the case of high load pressure. This means that the blocking valve can be built much less expensively and furthermore, various hydraulic control lines and elements of the conventional control system are no longer necessary. The combination of the load-sensing mode with the actuation of the blocking valve not equipped with pre-control results in a safety function for controlled and regulated hydraulic systems with a mass load. Since the control pressure level is low compared to the load pressure, the lowering of a large load can only take place from the neutral position of the servo valve. The possibility of sudden dropping of a large load at start-up is also thus precluded when the servo valve is or was inadvertently placed in its lowered position for whatever reason. It is thus possible to carry out (i) the volumetric flow regulation by the servo valve, and (ii) the switching function by which the blocking valve is opened, using a single control pressure, with one part of the control range preferably reserved for the switching function and with the control surface of the control element of the blocking valve being larger than that of the control element of the servo valve.

In the control system disclosed in the aforementioned U.S. Pat. No. 4,960,035, only by optimally improved coordination of the control characteristics of the servo valve on the one hand, and of the control unit 30 with the blocking valve on the other hand, does it become possible to inhibit the occurrence of reactions in the load line downstream from the blocking valve when switching off the control pressure in the neutral position C of the servo valve. The present invention therefore concerns an improvement so that when switching the control pressure closed and open from the neutral position of the servo valve, reactions in the load line downstream from the blocking valve are prevented. At the same time, it should be reliably ensured that the switching measures foreseen here have no influence on the function of the blocking valve when the servo valve passes through the above-mentioned neutral position.

SUMMARY OF THE INVENTION

In accordance with the invention, an additional control element for the control unit is provided that works against the control element acted upon by the common control line. This additional control element is fed from the common control pressure via a branch control line having two series-connected throttles. Between the two throttles a discharge line leading to the tank branches off, which line is closed in the neutral or middle position of the servo valve. In the two other switching positions of the servo valve, the additional control element is exhausted via one of the two throttles to the reservoir, while in the neutral position of the servo valve a pressure balance between the two control elements of the control unit takes place via the two series-connected throttles. If the servo valve thus remains in the neutral position for a longer period of time, the restoring spring of the blocking valve can bring the corresponding valve element into position at a control speed that is established by the two throttles in the branch control line. Thus by briskly switching off the pre-control pressure in the common control line the whole unit can be brought into switched-off mode without pressure reactions occurring in the load line downstream from the blocking valve, i.e., without oil escaping from this load line to the reservoir. On the other hand, the switching measures ensure that when rapidly passed through the neutral position of the servo valve, the blocking valve stays open because a damping occurs in the pressure build-up via the two series-connected throttles. The load-indicating line thus remains constantly at load pressure even when passed through the neutral position quickly.

An additional reduction of switching and device-related expenditure is achieved by utilizing the servo valve to close the branch control line when the servo valve is in its neutral position. In the other two positions of the servo valve, the branch control line is connected to the reservoir.

BRIEF DESCRIPTION OF THE DRAWING

The objects and advantages of the invention will become apparent from the following detailed description of a preferred embodiment thereof in connection with the accompanying drawings in which like numerals designate like elements. The sole FIGURE depicts schematically a control system or circuit for controlling a hydraulic power lift to which a service line leads.

DETAILED DESCRIPTION OF A PREFERRED EMBODIMENT OF THE INVENTION

The control system includes a 4/3 servo valve 10 that has connections to: (i) a pump line P that is fed by a variable displacement pump a tank line T that leads to a reservoir 4, (iii) a work or load line A that leads via a blocking valve 20 to a service line Z, and (iv) a discharge line 62 that is described in more detail below and for which an additional guiding edge 41 is provided. The service line Z feeds a hydraulic lift 8.

A load-indicating line $X_{LS}$ leads to the load line A and is exhausted to reservoir 4 in the depicted initial position B of the 4/3 servo valve 10 via the load line A, the valve 10, and the tank line T. Whenever pressure builds up in the load indicating line $X_{LS}$, that line furnishes a signal to a controller 6 for the variable displacement pump. The variable displacement pump is accordingly operated in either a working mode when there is an indicating signal (i.e., when there is a load-indicating pressure exceeding a threshold value), or a standby mode when there is no indicating signal (i.e., in the case of pressure below the threshold value).

The 4/3 servo valve 10 is biased toward its initial switching position B by a spring 11 and can be slid against the spring tension into sequentially arranged positions C and D by the application of a control pressure to a control element 12.

The blocking valve 20 sits between the load line A and the service line Z. It has a valve element 21 that is pressed against a valve seat 23 by means of a spring 22 to normally block the service line Z from the load line A.

To release the blocking valve 20 there is provided a control unit 30 that has a control rod 31. In the position shown, the unit 30 is held by a control element 42 in a position in which the control rod 31 does not open the valve element 21. The spring 22 ensures that when pressure is balanced on both sides of the control unit 30, the latter occupies the position shown. On the side of the control unit 30 opposite the control element 42, the control unit is provided with a control element 33. Pressure acting against the control element 33 in opposition to the pressure from control element 42 and the force of spring 22 may slide the control unit 30 and against the force of the spring 22, so that the control rod 31 opens the valve 20.

The control elements 12 and 33 are connected to a common control pressure line 35 and are acted upon by the same control pressure $X_2$. The control surface of the control element 12 of the 4/3 servo valve 10 can be smaller than that of the control element 33 of the control unit 30.

From the common control pressure line 35 a branch control line 60 branches off, led to the control element 42 of the control unit 30. It follows from the drawing that the control element 42 is disposed opposite to the control element 33 at the control unit 30, i.e. at the control side onto which the control pin acts, which pin is used for lifting the valve body 21 of the blocking valve 20 against the force of spring 22. In the branch control line 60 two throttles 43 and 44 are series-connected. Between the throttles 43 and 44 a pressure release line 62 branches off and leads to a guiding edge 41 of the 4/3 servo valve 10.

In the switching positions B and D of the servo valve 10, an exhausting of the line 62 to the tank line T takes place, but in the switching position C, i.e., in the neutral position of the servo valve 10 the discharge line 62 is closed. This results in the following operating characteristics of the control system.

In its initial position B the 4/3 servo line 10 exhausts to reservoir the load line A which remains blocked from the service line Z by the blocking valve 20. Thus, the load-indicating line $X_{LS}$ is also exhausted to reservoir. Since the load-indicating line $X_{LS}$ is relieved of pressure, the control block of the variable displacement pump contains no indicating signal; hence, the variable displacement pump is operating in standby mode. The initial switching position B of the 4/3 servo valve 10 is maintained by the spring 11 as long as the control pressure line 35 is free of pressure. The blocking valve 20 remains closed under the effect of the spring 22.

As soon as a control pressure $X_2$ is built up in the control line, that pressure acts upon both the control element 33 and the control element 12 to open the valve 20 and then shift the valve 10 to the closed or blocking position C. Since the release line 62 to the tank is open, no pressure builds up in the control element 42 to displace the control unit 30.

The control pressure $X_2$ rises very quickly to a neutral level as the 4/3 servo valve 10 is held in its blocking position C by the application of the control pressure $X_2$ to the control element 12, which pressure opposes the force of the spring 11. To prevent the 4/3 servo valve 10 from remaining too long in the initial switching position B after the control pressure reaches a sufficient pressure for opening the valve 20, the rise in control pressure $X_2$ to a pressure (i.e., a neutral pressure level) which moves the valve 10 to the blocking position C takes place at a great speed. After the control pressure $X_2$ has shifted the valve 10 to the blocking position C, the 4/3 servo valve 10 can be used for volumetric flow regulation from the service line Z to the tank line T by lowering the control pressure $X_2$ to a level which is low enough to permit the spring 11 to shift the valve spool 10 to the initial position B and yet which is high enough to keep the control unit 30 in a position holding the blocking valve 20 open.

Instead of lowering the control pressure $X_2$ from the neutral pressure level, the control pressure $X_2$ could be raised sufficiently to shift the valve 10 to the operating position D against the action of spring 11, for regulating the volumetric flow from pump line P to the service line Z.

In operation of the control device according to the present invention, a portion of the control pressure range is reserved for actuation of the control unit 30, which portion of the pressure range is accordingly not available for volumetric flow regulation by the 4/3 servo valve 10.

If, for example, a control pressure range of 0 to 20 bar is available for the control pressure $X_2$, it is possible, by a an appropriate arrangement of the springs 11 and 32, to establish a switching pressure level at which the valve 20 is opened to be 5 bar, and to establish the neutral pressure level at which the 3/3-way servo valve 10 is held in its blocking position C to be 12.5 bar. For volumetric flow regulation in the initial position B of the 4/3 servo valve 10, a control pressure range of 7.5 bar, namely between 12.5 bar as an for volumetric flow regulation in the operating position D of the 4/3 servo valve 10, a control pressure range of 7.5 bar, namely between 20 bar as an upper limit and 12.5 bar as a lower limit is available.

If the servo valve 10 remains long enough in the neutral position, a pressure balance between the control elements 33 and 42 of the control unit 30 can occur via the throttles 44 and 43. If, for example, the control surfaces of the control elements 33 and 42 have been kept equally large, the spring 22 can bring the valve element 21 into a position closing the valve 20. In this mode, by briskly switching off the pre-control pressure $X_2$, the whole unit can be brought into its switched-off state without any reaction occurring in the load line section Z downstream from the blocking element. If, however, the blocking position C of the servo valve is passed through rapidly during the normal operation, the valve element 21, because of the damping by the throttles 43 and 44, remains open afterwards just as before, and the load-indicating line $X_{LS}$ stays at load pressure. It is thus apparent that the above-described control system is reliably able, with limited circuit expenditure, to prevent reactions in the line Z when switching the control pressure $X_2$ in the control line 35 off and on.

The invention thus involves a control system for a hydraulic power lift driven by a variable displacement pump. The blocking valve can be opened at least for lowering the power lift. The load-indicating line transmits the load pressure, and a control device switches the valve open and closed and regulates the volumetric flow from a pump line into a load line leading to the power lift or from the power lift into the tank line leading to the reservoir. This control device has a servo valve with three positions for adjusting the volumetric flow to and from the power lift and has a control element for switching the blocking valve open and closed. The load-indicating line is connected to the load line and, in the initial switching position of the control device, is connected with the tank via the servo valve. Disposed adjacent to the initial switching position of the servo valve, in which the load line is connected with the tank line, is the middle or blocking position; adjacent to that is a switching position in which the load line is connected with the pump line. The first adjusting springs of the control unit and of the servo valve are acted upon via a common control line. To ensure that no pressure reactions occur in the service line Z downstream of the blocking valve when the control pressure in the common control line is switched on and off at a time when the servo valve is in a blocking position, a branch control line branches off from the control line, which branch control line is led to an additional control element of the control unit opposing the first control element and which has two throttles between which a discharge line leading to the tank branches off and is closed in the middle position of the servo valve.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A control system for conducting hydraulic fluid from a variable displacement pump to a hydraulic lift for raising the lift and for conducting hydraulic fluid from said hydraulic lift to a reservoir for lowering the lift; said variable displacement pump being controlled by pressure in a load indicating line; a service line extending between said hydraulic lift and a blocking valve; a load line extending between said blocking valve and a servo valve; said blocking valve being operable to communicate said load line with said service line; a pump line for communicating pump pressure to said servo valve; said servo valve including a first control element responsive to the application of a control pressure fluid for moving said servo valve between: a first position communicating said load line with a tank line leading to a reservoir for lowering said hydraulic lift, a second position blocking said load line, and a third position communicating said load line with said pump line for raising said hydraulic lift; said load-indicating line communicating with said load line for increasing pump displacement in response to a preselected increase of pressure in said load line; a control unit arranged for controlling the opening and closing of said blocking valve, said control unit including a second control element responsive to the application of a control pressure fluid for moving said control unit in a manner effecting an opening of said blocking valve; a control pressure line common to both of said first and second actuators for applying a control pressure fluid thereto; said control unit including a third control element arranged to act in opposition to said second control element in response to the application of a control pressure fluid thereto for effecting a closing of said blocking valve; a branch control line branching from said common control line and leading to said third control element for conducting control pressure fluid thereto, said branch control line containing two throttles; a discharge line communicating with said branch control line at a location between said throttles and communicating with said reservoir; said servo valve arranged to block said discharge line from said reservoir when said servo valve is in its second position.

2. A control system according to claim 1, wherein said discharge line extends to a guide edge of said servo valve.

3. A control system according to claim 1, wherein said first and second control elements are arranged such that said control unit is moved to open said blocking valve before said servo valve is moved out of said first position.

4. A control system according to claim 1, wherein said blocking valve is spring-biased toward a closed condition, the spring bias serving to supplement the action of said third control element.

* * * * *